US006957630B1

(12) United States Patent
Mastronarde

(10) Patent No.: US 6,957,630 B1
(45) Date of Patent: Oct. 25, 2005

(54) FLEXIBLE ASSEMBLY OF ONCE-THROUGH EVAPORATION FOR HORIZONTAL HEAT RECOVERY STEAM GENERATOR

(75) Inventor: Thomas P. Mastronarde, West Hartford, CT (US)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/907,431

(22) Filed: Mar. 31, 2005

(51) Int. Cl.[7] ..... F22D 7/00
(52) U.S. Cl. ..... 122/406.4; 122/7 R; 122/451 S
(58) Field of Search ..... 122/1 B, 406.4, 122/406.3, 448.4, 451 S, 479.7, 235.23, 7 R

(56) References Cited

U.S. PATENT DOCUMENTS 4,685,426 A * 8/1987 Kidaloski et al. ..... 122/214
4,915,062 A * 4/1990 Dolezal ..... 122/406.5
6,189,491 B1 * 2/2001 Wittchow et al. ..... 122/1 C
6,868,807 B2 * 3/2005 Franke et al. ..... 122/406.4

* cited by examiner

*Primary Examiner*—Gregory A. Wilson
(74) *Attorney, Agent, or Firm*—Antonelli, Terry, Stout & Kraus, LLP

(57) ABSTRACT

A steam generator is disclosed herein. The steam generator includes an inlet manifold, a discharge manifold, a heating gas duct, and at least one once-through heating area in the heating-gas duct. The once-through heating area is formed from multiple single-row header-and-tube assemblies. Each single-row header-and-tube assembly includes a plurality of steam generator tubes connected in parallel, an inlet header connected to the inlet manifold, and a discharge header connected to the discharge manifold. Each inlet header is connected to the inlet manifold by one of multiple first link pipes, and each discharge header is connected to the discharge manifold by one of multiple second link pipes. Each said steam generator tube of each of the single-row header-and-tube assemblies has an inside diameter that is less than an inside diameter of any of the first or second link pipes.

12 Claims, 7 Drawing Sheets

FLEXIBLE ASSEMBLY OF ONCE-THROUGH EVAPORATION FOR HORIZONTAL HEAT RECOVERY STEAM GENERATOR

FIELD OF THE INVENTION

The present invention is related to steam generators, and more particularly to horizontal once through heat recovery steam generators.

BACKGROUND OF THE INVENTION

Heat Recovery Steam Generators (HRSGs) include evaporator tube rows (multiple tube rows are commonly referred to as tube bundles) that transfer heat from an exhaust-gas stream, such as that from a combustion turbine or other industrial process that produces hot gas, to a fluid inside the evaporator tubes. Horizontal HRSGs employ vertical evaporator tube rows arranged in cross-flow to an exhaust-gas stream that flows in a horizontal direction across the vertical evaporator tubes. An evaporator section on HRSGs typically includes lower manifolds (headers) to distribute water to the bottom of the evaporator tubes, and upper manifolds (headers) to collect a mixture of steam and water from the top of the evaporator tubes.

One type of horizontal HRSG is a circulation type horizontal HRSG. In such HRSGs, circulating fluid is only partly evaporated when passing through evaporator tubes. The fluid inside the evaporator tubes never becomes superheated because an excess mass flow of fluid is maintained at all times. For this reason, the temperature of the fluid inside the evaporator tubes of circulation type horizontal HRSGs is essentially constant. The fluid that is not evaporated in the process is fed again to the same evaporator tubes for further evaporation after separation of generated steam in a steam drum.

Walls of a steam drum in a circulation type horizontal HRSG are subjected to large thermal stresses when the steam drum is rapidly heated. Repeated heating and cooling reduces the life of the steam drum, leading to eventual failure of the circulation type horizontal HRSG. To avoid steam drum failure, operating restrictions are typically imposed on circulation type horizontal HRSGs to reduce the rate of warm-up of the steam drum.

Another type of horizontal HRSG is a once-through horizontal HRSG. This type horizontal HRSG lacks a steam drum, thus operating restrictions to avoid rapid warm-up are not necessary. Further, a once-through type horizontal HRSG is not subject to any pressure limitation. Therefore, live-steam pressures well above the critical pressure of water ($P_{cri}$=221 bar), where there is only a slight difference in density between a medium similar to a liquid and a medium similar to steam, are possible. A high live-steam pressure promotes a high thermal efficiency and thus low $CO_2$ emissions of a fossil-fired power station. Fluid fed through a once-through HRSG is completely evaporated in a single pass through either a single heating area, or a plurality of heating areas connected in series.

In addition, a once-through type horizontal HRSG has a simple construction compared with that of a circulation type horizontal HRSG, and can therefore be manufactured at an especially low cost compared to the manufacture of a circulation type horizontal HRSG. Further, a once-through type horizontal HRSG, in contrast to a once-through type vertical HRSG, can be manufactured especially simply and at an especially low production and assembly cost.

Common to all horizontal HRSGs, the temperature of the exhaust-gas stream declines from the exhaust-gas inlet to the exhaust-gas outlet of the evaporator section. The amount of heat transferred in each tube row over which the exhaust-gas flows is proportional to the temperature difference between the exhaust-gas and the fluid in the tubes. Therefore, for each successive row of evaporator tubes in the direction of exhaust-gas flow, a smaller amount of heat is transferred, and the heat flux from the exhaust-gas to the fluid inside the tube declines with each tube row from the inlet to the outlet of the evaporator section.

Geodetic pressure drop describes the pressure drop due to the weight of the water column and steam column relative to the area of a cross-section of a flow medium in a steam-generator tube. Friction pressure loss describes the pressure drop in a steam-generator tube as a result of the flow resistance for the flow medium. The total pressure drop in a steam-generator tube is essentially composed of the geodetic pressure drop and the friction pressure loss.

During especially intense heating of an individual steam-generator tube, the steam generation in the steam-generator tube becomes especially high. The weight of the flow medium that has not evaporated in the steam-generator tube therefore decreases, so that the geodetic pressure drop in the steam-generator tube likewise decreases. However, in a once-through type steam generator, all steam-generator tubes are connected in parallel inside a once-through heating area. Each of these parallel tubes have the same total pressure drop on account of their common connection to a flow medium inlet and their common connection to a flow medium discharge. If there is a geodetic pressure drop in one of the parallel steam-generator tubes that is especially low compared with the other steam-generator tubes connected in parallel with it, on account of different heat intensity, an especially large quantity of flow medium then flows for a pressure balance through the tube heated to a greater degree if the geodetic pressure drop is on average the dominant portion of the total pressure drop on account of the configuration of a once-through heating area.

In other words, a steam-generator tube heated more intensely, compared with steam-generator tubes connected in parallel with it, has an increased flow rate of a flow medium. On the other hand, a steam-generator tube heated to an especially low degree compared with other steam-generator tubes connected in parallel with it has an especially low flow rate of flow medium. By a suitable specification of the ratio of friction pressure loss to geodetic pressure drop due to the configuration of the steam-generator tubes, in particular with regard to the selected mass-flow density in the steam-generator tubes, this effect can be utilized for automatic adaptation of the flow rate of each steam-generator tube to its heating.

A once-through type horizontal HRSG that compensates for this difference in flow rate is known. However, in all once-through type horizontal HRSGs, including that accounting for pressure differences, the temperature of steam-generator tube metal is determined by both the amount of heat flux across the steam-generator tube wall and the average temperature of the flow medium inside the steam-generator tube. Since the heat flux declines from the inlet to the outlet of the evaporator section, the temperature of the steam-generator tube metal is different for each row of steam-generator tubes included in the evaporator section.

Each manifold (header) of a horizontal HRSG that runs perpendicular to the exhaust-gas flow acts as a collection point for multiple rows of tubes. These headers are of relatively large diameter and thickness to accommodate the multiple tube rows. FIGS. 1*a* and 1*b* are two views of such an assembly 100, known as a multi-row header-and-tube assembly, utilized in once-through type horizontal HRSG that compensates for pressure differences. Included in the assembly 100 is a header 101 and multiple tube rows 105A–105C. As shown in FIG. 1*a*, each individual tube row 105A–105C includes multiple tubes. In the interest of clarity of illustration, FIG. 1*b* only shows a single tube in each tube row 105A–105C. Since each of tube rows 105A–105C is at a different temperature, the mechanical force due to thermal expansion is different for each tube row 105A–105C. Such differential thermal expansion causes stress at tube bends and the attachment point of each individual tube to the header 101. Further, also contributing to thermal stresses at the attachment point of each individual tube to the header 101 is a difference in thickness between the relatively thin-wall tubes as compared to the thick-wall header 101. Under certain operating conditions, these stresses can cause failure of the attachment point, especially if the assembly 100 is subjected to many cycles of heating and cooling.

Thus, while a once-through type horizontal HRSG that both compensates for pressure differentials in steam-generator tubes and lacks a steam drum is known, it is nonetheless subject to failure due to thermal stresses in other components, especially in a multi-row header-and-tube assembly 100. Accordingly, a need exists for a once-through horizontal HRSG that is capable of both rapid heating and cooling as well as a large number of start-stop cycles.

OBJECTS OF THE INVENTION

It is an object of the present invention to provide a once-through type horizontal heat recovery steam generator that is capable of both rapid heating and cooling and a large number of start-stop cycles in which a flow rate proportional to the heat input through individual tubes is achieved in a system of parallel steam generator tubes.

The above-stated object, as well as other objects, features, and advantages, of the present invention will become readily apparent from the following detailed description which is to be read in conjunction with the appended drawings.

SUMMARY OF THE INVENTION

In accordance with the present invention, a steam generator is provided. The steam generator, which could be a heat recovery steam generator, or another type steam generator, includes an inlet manifold, a discharge manifold, a heating gas duct, and at least one once-through heating area disposed in the heating-gas duct through which a heating gas flow is conducted. The once-through heating area is formed from multiple single-row header-and-tube assemblies. Each individual single-row header-and-tube assembly includes a plurality of steam generator tubes connected in parallel for a through flow of a flow medium.

Also included in each individual single-row header-and-tube assemblies is an inlet header connected to the inlet manifold and a discharge header connected to the discharge manifold. Each inlet header is connected to the inlet manifold by one of multiple first link pipes, and each discharge header is connected to the discharge manifold by one of multiple second link pipes. Each said steam generator tube of each of the single-row header-and-tube assemblies has an inside diameter that is less than an inside diameter of any of the first or second link pipes.

According to one aspect of the present invention, the heating gas flow is conducted in an approximately horizontal heat-gas direction. In another aspect of the inventive steam generator, at least one of the steam generator tubes that is associated with a first one of the single-row header-and-tube assemblies is heated to a greater extent than at least one of the steam generator tubes associated with a second one of the single-row header-and-tube assemblies. Also in this aspect, the at least one steam generator tube associated with the first single-row header-and-tube assembly has a higher flow rate of the flow medium than the at least one steam generator tube associated with the second single-row header-and-tube assembly.

According to yet another aspect of the present invention, the inside diameter of the inlet manifold has a larger diameter than the inside diameter of any inlet header. Also in this aspect, the inside diameter of the inlet manifold has a larger diameter than the inside diameter of any discharge header.

In still another aspect, each steam generator tube of a first one of the single-row header- and-tube assemblies has a higher flow rate of the flow medium than each steam generator tube of a second one of the single-row header-and-tube assemblies that is disposed downstream of the first single-row header-and-tube assembly in the heating gas flow direction.

According to yet another aspect of the present invention, the inside diameter of each steam generator tube of a first single-row header-and-tube assembly is larger than the inside diameter of each steam generator tube of a second single-row header-and-tube assembly that is disposed downstream of the first single-row header-and-tube assembly in the heating gas flow direction.

In another aspect of the present invention at least one steam generator tube of at least one single-row header-and-tube assemblies has a choke device. In still another aspect, each inlet header is connected to the inlet manifold by one of the first link pipes, and at least one of the first link pipes includes a choke device.

According to yet another aspect, the steam-generator tubes of at least one once-through heating area are advantageously configured or dimensioned on average for a ratio of friction pressure loss to a geodetic pressure drop at a full load of less than 0.4, preferably less than 0.2.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF PREFERRED EMBODIMENT(S)

Figure 2A:
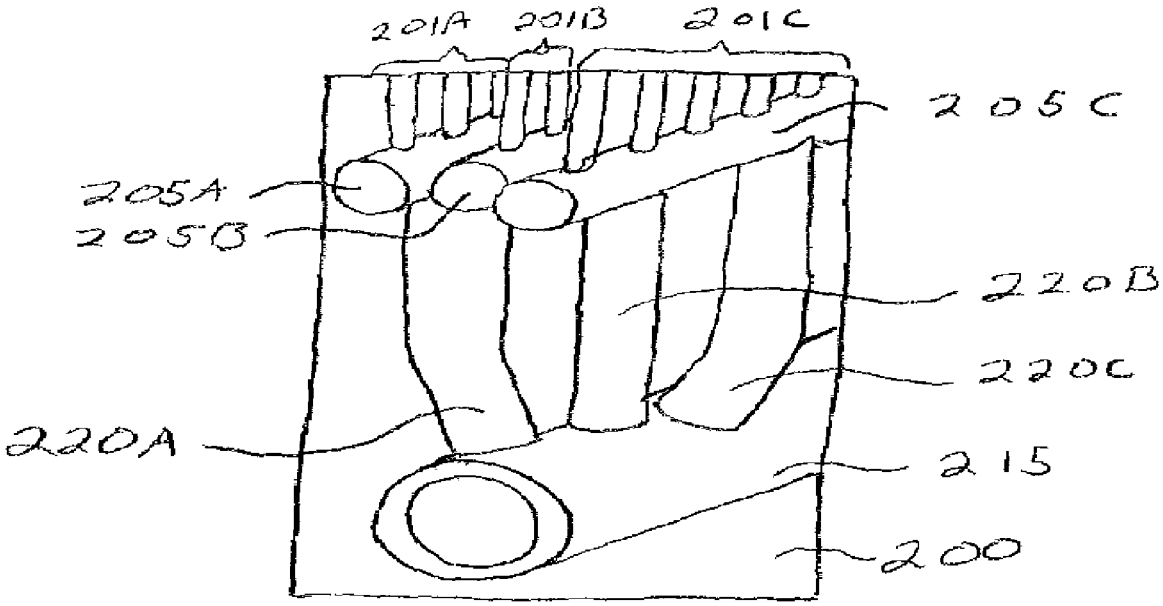
FIG. 2*a* is a first view of a stepped component thickness with single row header-and-tube assembly in accordance with certain aspects of the present invention.
Figure 2B:
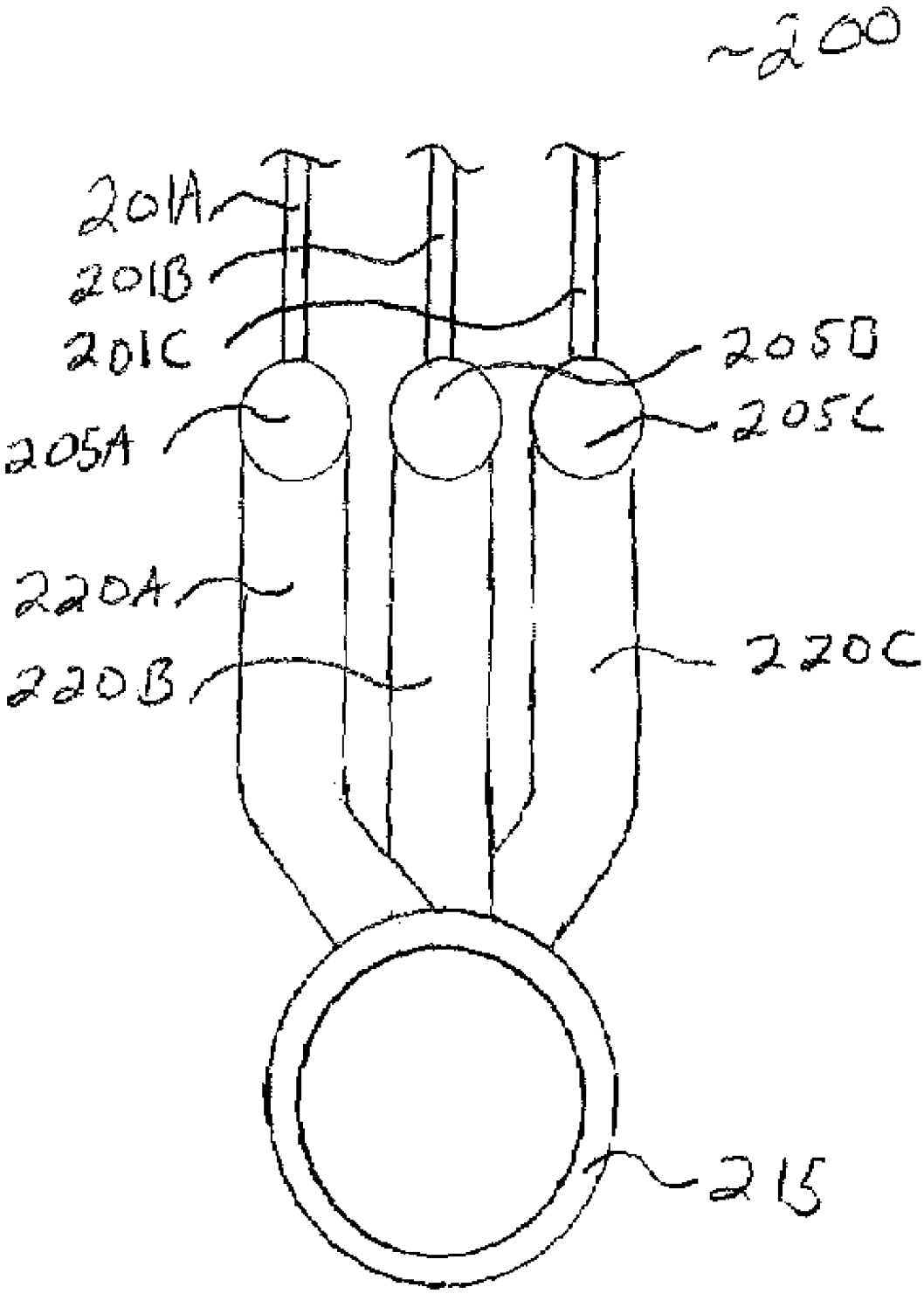
FIG. 2*b* is a second view of the stepped component thickness with single row header-and-tube assembly of FIG. 2*a*.

Referring to FIGS. 2*a* and 2*b*, a stepped component thickness with single row header-and-tube assembly 200 that is not subject to bend and attachment failure due to thermal stresses, discussed above, is provided for use in a once-through type horizontal HRSG. FIGS. 2*a* and 2*b* are different views of the same assembly 200. In the interest of clarity in the illustration, FIG. 2*b* only shows a single tube in each tube row 201A–201C. Assembly 200 includes single tube rows 201A–201C, each attached to a common header 205A–205C respectively. Thus, tube row 201A is attached to common header 205A, tube row 201B is attached to common header 205B, and tube row 201C is attached to common header 205C. Such an arrangement may be referred to as a single-row header-and-tube assembly. Each header 205A–205C is connected to a collection manifold 215 via a link pipe 220A–220C. Thus, header 205A is connected to the collection manifold 215 via link pipe 220A, header 205B is connected to the collection manifold 215 via link pipe 220B, and header 205C is connected to the collection manifold 215 via link pipe 220C.

Each tube of each tube row 201A–201C has a smaller diameter than each common header 205A–205C and each link pipe 220A–220C. Each common header 205A–205C has a smaller diameter and thinner wall thickness than each collection manifold 215.

Figure 1A:
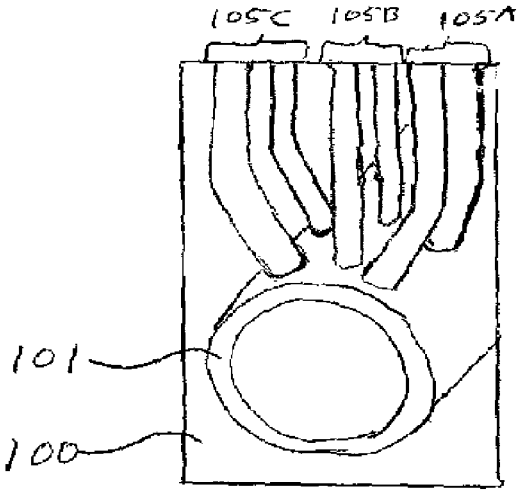
Figure 1a Prior Art
FIG. 1*a* is a first view of a multi-row header-and-tube assembly utilized in prior art heat recovery steam generators.
Figure 1B:
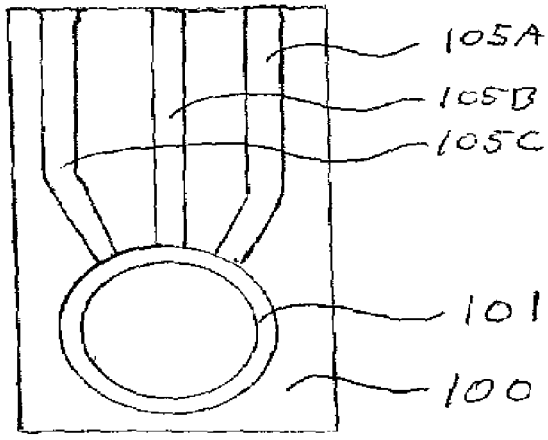
Figure 1b Prior Art
FIG. 1*b* is a second view of the multi-row header-and-tube assembly shown in FIG. 1*a*.

As a result of this configuration, a high concentration of stresses during heating and cooling does not occur at bends and attachment points. More particularly, because the tubes of each tube row 201A–201C do not have bends, no thermal stress associated with bends exists. Also, bending stress at the weld attachment of each tube to each header 205A–205C does not occur because a bending moment imposed by tube bends during heating does not exist. Thus, the single-row assembly can withstand many more cycles of heating and cooling than the multi- row header-and-tube assembly 100 depicted in FIG. 1, and discussed above.

Figure 3:
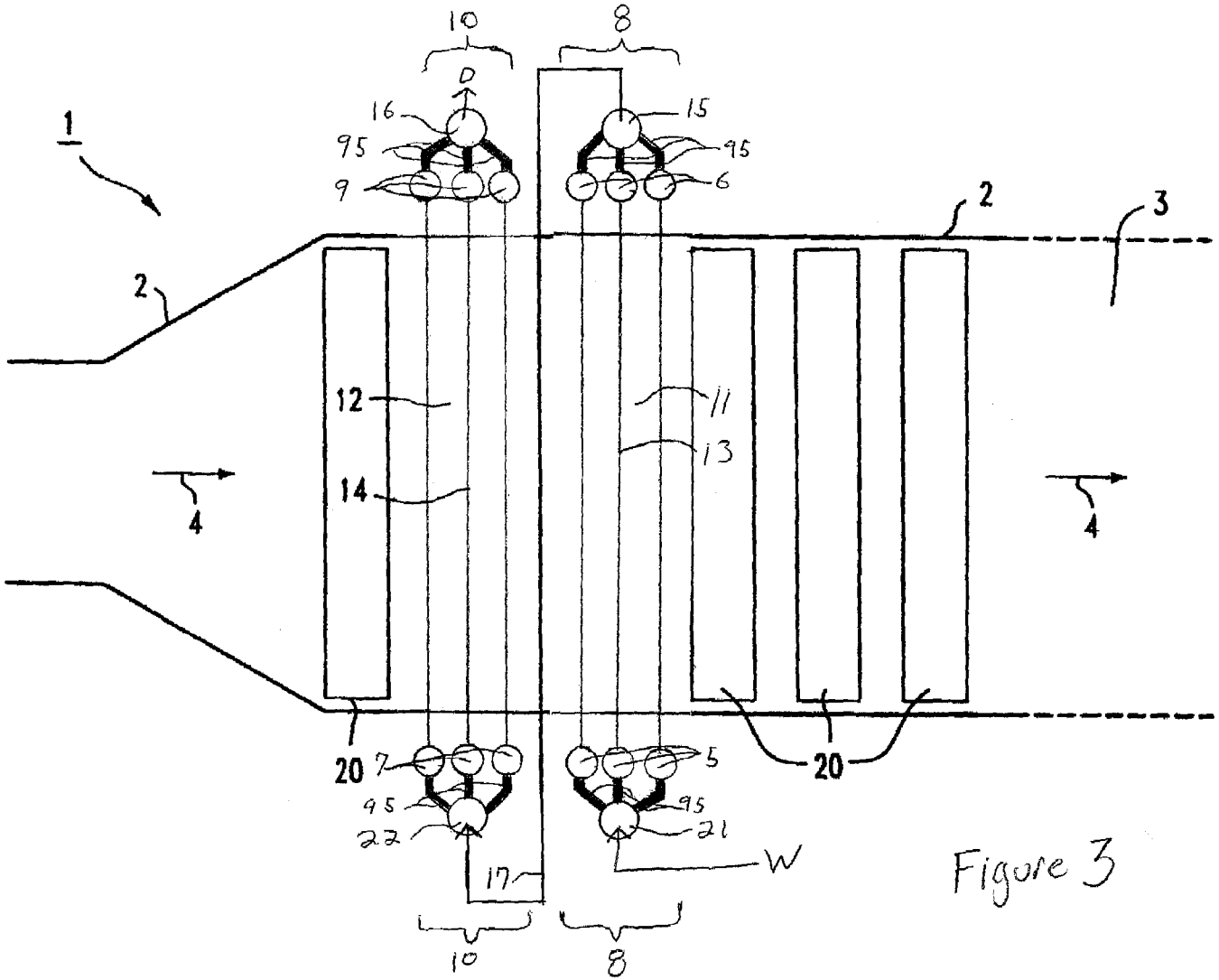
FIG. 3 is a view of one embodiment of a heat recovery steam generator utilizing the stepped component thickness with single row header-and-tube assembly of FIGS. 2*a* and 2*b* in accordance with certain aspects of the present invention.

Referring now to FIG. 3, there is shown one embodiment of a once-through type horizontal heat recovery steam generator of the present invention, hereinafter generally designated as steam generator 1, and it can be seen that the steam generator 1 is disposed downstream of a gas turbine (not shown) on the exhaust-gas side thereof. The steam generator 1 has an enclosing wall 2 which forms a heating-gas duct 3 through which flow can occur in an approximately horizontal heating-gas direction indicated by the arrows 4 and which is intended to receive the exhaust-gas from the gas turbine. Once-through heating areas 8 and 10 are positioned in the heating-gas duct 3. In the exemplary embodiment of FIG. 3, as well as the embodiments shown in FIGS. 4 and 5, two once-through heating areas 8 and 10 are shown, but one once-through heating area, or a larger number of once-through heating areas may also be provided without departing from the essence of the present invention.

Figure 4:
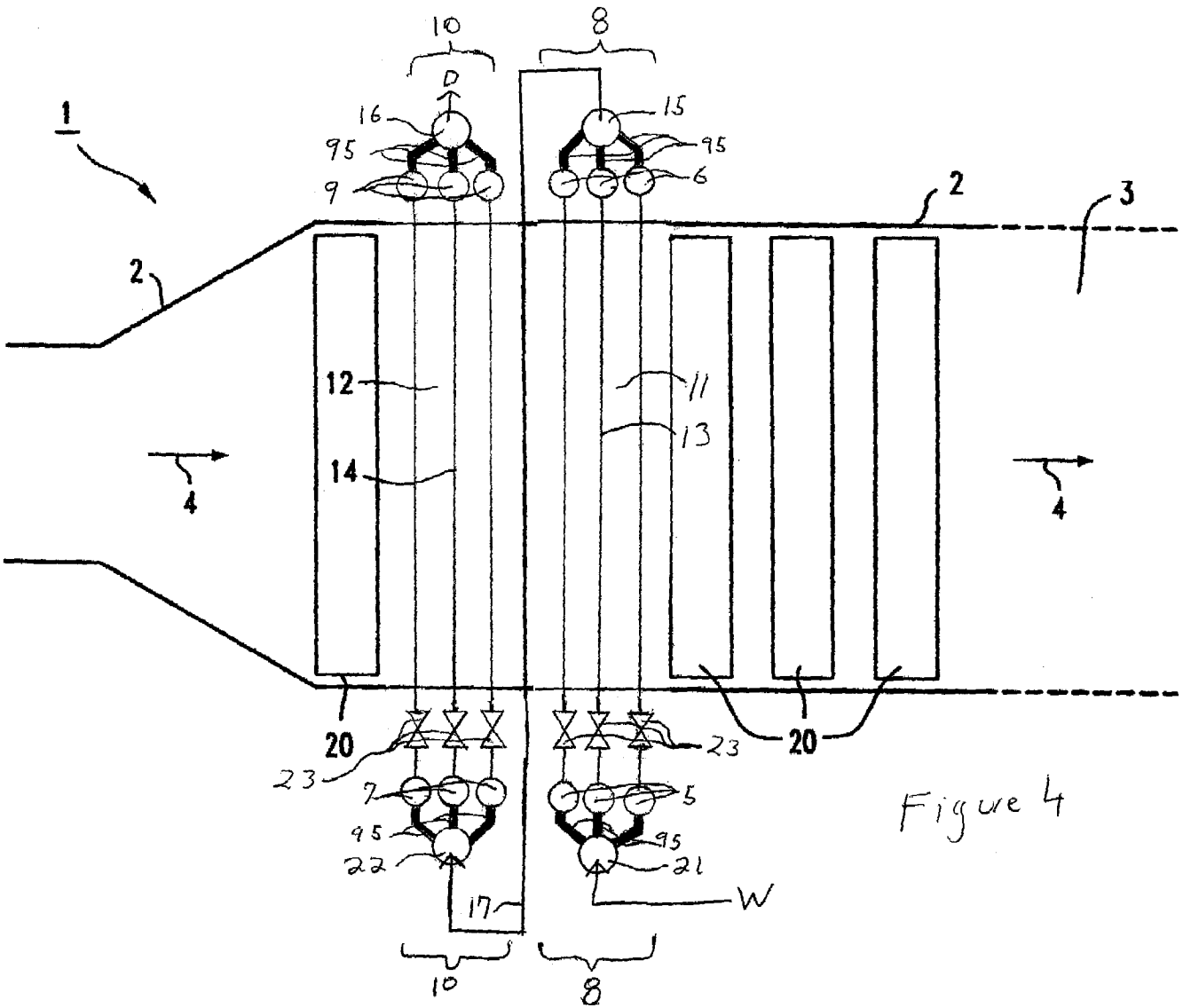
FIG. 4 is a view of another embodiment of a heat recovery steam generator utilizing the stepped component thickness with single row header-and-tube assembly of FIGS. 2*a* and 2*b* in accordance with certain aspects of the present invention.
Figure 5:
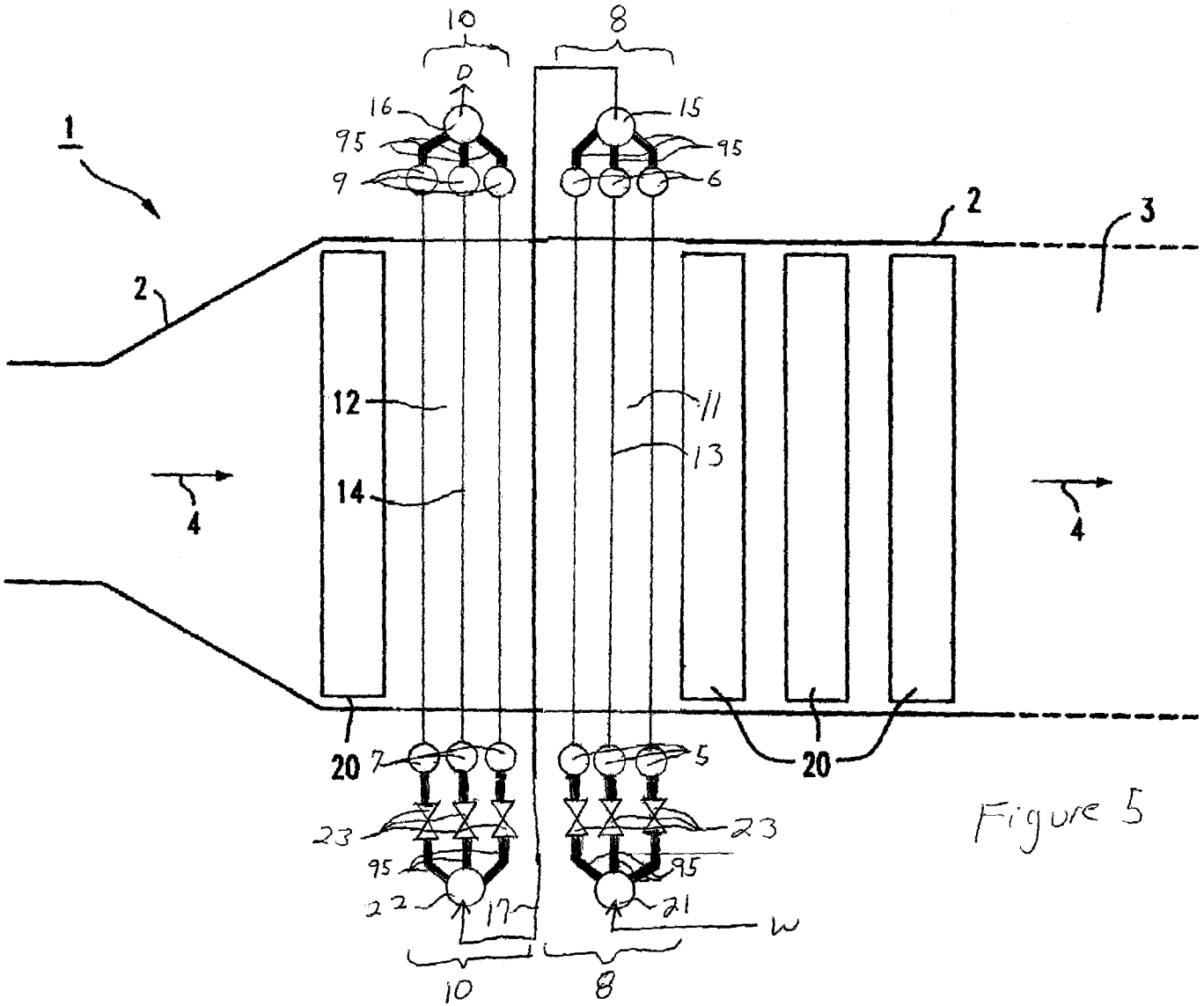
FIG. 5 is a view of yet another embodiment of a heat recovery steam generator utilizing the stepped component thickness with single row header-and-tube assembly of FIGS. 2*a* and 2*b* in accordance with certain aspects of the present invention.

The once-through heating areas 8 and 10, common to the respective embodiments illustrated in FIGS. 3 through 5, contain a number of tube rows 11 and 12, respectively, which are disposed one behind the other in the heating-gas direction. Each tube row 11 and 12 in turn has a number of vertical steam-generator tubes 13 and 14, respectively, which are disposed next to one another in the heating-gas direction. In FIG. 3, only a single vertical steam-generator tube 13 or 14 can be seen in each tube row 11 and 12.

Steam-generator tubes 13 of the common tube row 11 of the first once-through heating area 8 are each connected in parallel to a common inlet header 5, forming a single-row header-and-tube inlet assembly for each row 11, discussed above and shown in FIG. 2. Also, the steam-generator tubes 13 of the common tube row 11 of the first once-through heating area 8 are each connected to a common discharge header 6, thus forming a single-row header-and-tube discharge assembly for each row 11. Likewise, steam-generator tubes 14 of a common tube row 12 of the second once-through heating area 10 are each connected in parallel to a common inlet header 7, forming a single-row header-and-tube inlet assembly for each row 12, and are also each connected in parallel to a common discharge header 9, thus forming a single-row header-and-tube discharge assembly for each row 12.

Each single-row header-and-tube inlet assembly of the first once-through heating area 8 is connected to an inlet manifold 21 via a link pipe 95, thus forming a stepped component thickness with the single row header-and-tube inlet assembly. Also, each single-row header-and-tube discharge assembly of the first once-through heating area 8 is connected to a discharge manifold 15 via a link pipe 95, thus forming a stepped component thickness with the single row header-and-tube discharge assembly.

Likewise, each single-row header-and-tube inlet assembly of the second once-through heating area 10 is connected to an inlet manifold 22 via a link pipe 95, thus forming another stepped component thickness with the single row header-and-tube inlet assembly. Also, each single-row header-and-tube discharge assembly of the second once-through heating area 10 is connected to a discharge manifold 16 via a link pipe 95, thus forming another stepped component thickness with single row header-and-tube discharge assembly.

Flow medium W enters the first once-through heating area 8 through inlet manifold 21, flows in parallel though the tube rows 11, and exits the first once-through heating area 8 though discharge manifold 15. Flow medium W then travels through downpipe system 17 and enters the second once-through heating area 10 through inlet manifold 22, flows in parallel through the tube rows 12, and exits the second once-through heating area 10 through discharge manifold 16.

The flow medium W evaporates on passing through the first and second once-through heating areas 8 and 10, and is drawn off as steam D after discharge from the second once-through heating area 10 via discharge manifold 16. The evaporator system formed from the once-through heating areas 8 and 10 is connected in the water/steam circuit (not shown) of the steam turbine. In addition to the evaporator system containing the once-through heating areas 8 and 10, a number of further heating areas 20 indicated schematically in FIGS. 3, 4 and 5 are connected in the water/steam circuit of the steam turbine. The heating areas 20 may, for example, be superheaters, intermediate-pressure evaporators, low-pressure evaporators, and/or preheaters.

The once-through heating areas 8 and 10 are configured such that the differences in the heating of the steam-generator tubes 13 and 14 due to their position in the exhaust-gas flow only lead to small temperature and/or steam content differences in the flow medium W discharging from the respective steam-generator tubes 13 and 14. That is, the flow medium W will have approximately the same temperature and/or the same steam content for each steam-generator tube 13 or 14 belonging to the same one of the once-through heating area 8 or 10.

To achieve approximately the same discharge temperature and/or steam content, each steam-generator tube 13 of heating area 8 has a higher flow rate of the flow medium W than each steam-generator tube 13 of heating area 8 disposed downstream of it in the exhaust-gas flow direction. That is, those steam-generator tubes 13 positioned in the hotter exhaust-gas have a higher flow rate than those positioned in the cooler exhaust-gas. Likewise, each steam-generator tube 14 of heating area 10 has a higher flow rate than each steam-generator tube 14 of heating area 10 disposed downstream of it in the exhaust-gas flow direction.

In the embodiment of a once-through heat recovery steam generator in accordance with the present invention as depicted in FIG. 3, the steam-generator tubes 13 of the first once-through heating area 8 are configured in such a way that, during full-load operation of the steam generator 1, the ratio of a friction pressure loss to a geodetic pressure drop within the respective steam-generator tube 13 is on average less than 0.2. On the other hand, the steam-generator tubes 14 of the second once-through heating area 10 are configured in such a way that, during full-load operation of the steam generator 1, the ratio of the friction pressure loss to the geodetic pressure drop within the respective steam-generator tube 14 is on average less than 0.4.

Regarding the ratio of the friction pressure loss to the geodetic pressure drop, in the construction of the steam generator tubes 13 and 14 the relevant variables can be determined according to the relationships specified in the publication of Q. Zheng, W. Kohler, W. Kastner and K. Riedle entitled "Druckverlust in glatten und innenberippten Verdampferrohren", Warme- und Stoffubertragung 26,pp. 323–330, Springer-Verlag 1991, and of the publication of Z. Rouhani entitled "Modified Correlation for Void-Fraction and Two-Phase Pressure Drop", AE-RTV-841, 1969. In this regard, for a steam generator configured for full-load pressure at a superheater discharge pressure of 180 bar or less, the characteristic values to be used therefore are those for the full-load operating state. On the other hand, for a steam generator configured for a full-load pressure of more than 180 bar, the characteristic values to be used therefore are those for a part-load operating state at an operating pressure at a superheater discharge pressure of about 180 bar.

Because of the different pressures resulting from the different exhaust-gas temperatures, each steam-generator tube 13 or 14 of the once-through heating area 8 and 10 is expediently configured for a higher flow rate of the flow medium than each steam-generator tube 13 or 14 disposed downstream of it in the heating-gas direction and belonging to the same one of the once-through heating area 8 or 10.

Figure 6:
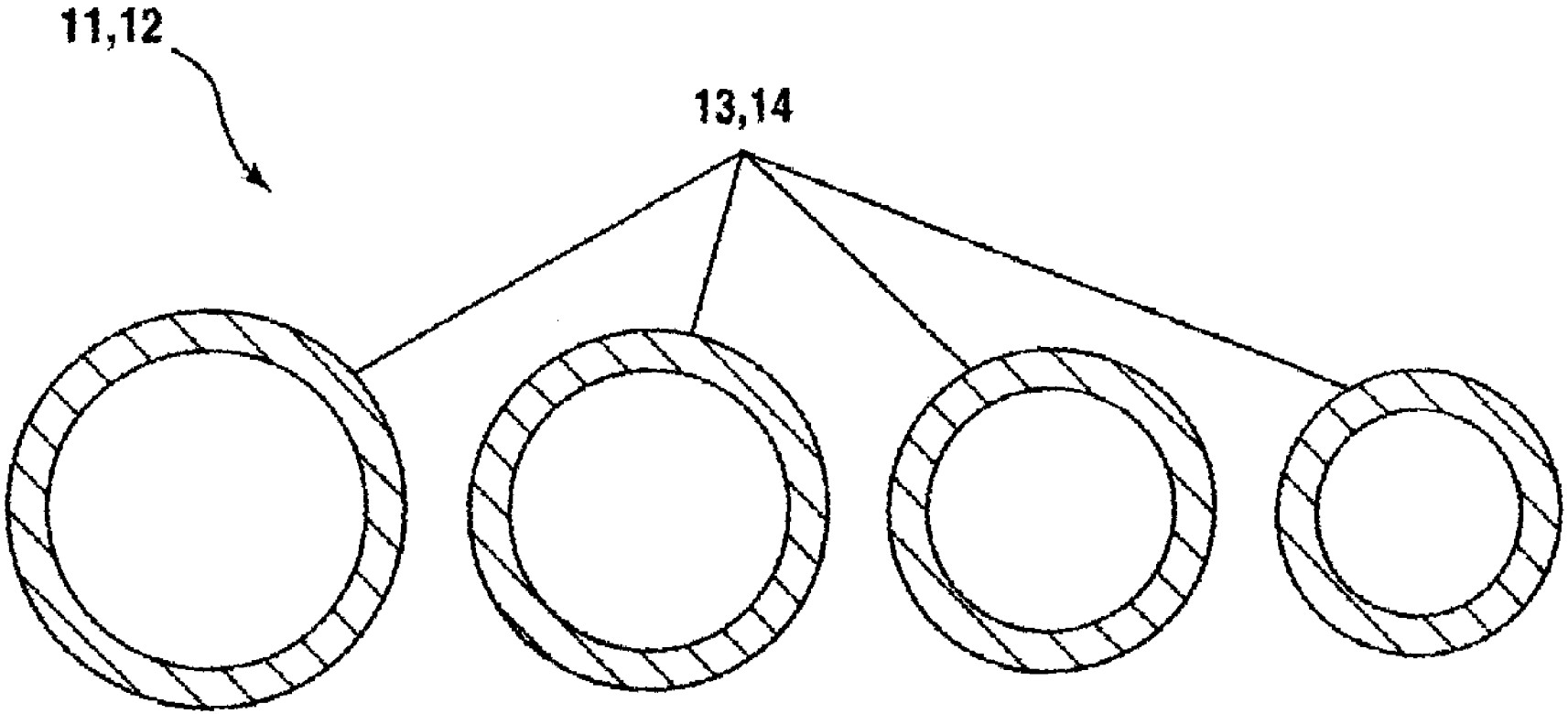
FIG. 6 is a cross-sectional representation of tubes having an increasing inner diameter from right to left.

To achieve the different flow rates, each steam-generator tube 13 and 14 of the once-through heating area 8 and 10, respectively, may have a larger inside diameter than each steam-generator tube 13 or 14 disposed downstream of it in the heating-gas direction and belonging to the same one of the once-through heating area 8 or 10, as is depicted in FIG. 6. Such a construction, in an especially simple manner ensures that the steam-generator tubes 13 or 14 in a region of comparatively high exhaust-gas temperature have a comparatively high flow rate of the flow medium W as compared to those steam-generator tubes 13 or 14 in a region having a comparatively lower exhaust-gas temperature.

In accordance with the embodiment depicted in FIG. 4, a valve, such as a choke device 23, is in each case connected upstream of each steam-generator tube 13 or 14 of the once-through heating areas 8 and 10, respectively, in the direction of flow of the flow medium W in order to establish a flow rate adapted to the respective heating to which each steam-generator tube 13 or 14 is subjected. This enables the flow rate through the steam-generator tubes 13 and 14 of the once-through heating areas 8 and 10 to be adjusted in order to thereby accommodate their different levels of heating. In this configuration, the flow through those steam-generator tubes 13 and 14 heated to a lower degree as compared with those steam-generator tubes 13 and 14 of the same one of the once-through heating area 8 or 10 can be reduced, as desired.

In accordance with the embodiment depicted in FIG. 5, choke devices 23 are placed in the link pipes 95. This enables the flow to each steam-generator tube 13 or 14 of an entire tube row 11 or 12 to be reduced, as desired. Thus, the steam-generator tubes 13, 14 of the once-through heating areas 8 and 10, respectively, are again configured in such a way that, during operation of the steam generator 1 the ratio of the friction pressure loss to the geodetic pressure drop in the respective steam-generator tube 13, 14 is on the average less than 0.2 or 0.4, respectively. A choke device 23 as such is connected upstream of each of the tube rows 11 and 12.

Each steam generator tube 13 and 14, of any or all of FIGS. 3 through 5, may have, as desired, ribbing on their outside. In addition, each steam-generator tube 13 and 14 may expediently be provided, as desired, with thread-like ribbing on its inner wall in order to increase the heat transfer from the steam-generator tube 13 and 14 to the flow medium W flowing in it.

The present invention is not to be limited in scope by the specific embodiments described herein. Indeed, various modifications of the present invention in addition to those described herein will be apparent from the foregoing description and accompanying drawings to those of skill in the art. Thus, such modifications are intended to fall within the scope of the appended claims.

What is claimed is:

1. A steam generator, comprising:

an inlet manifold;

a discharge manifold;

a heating gas duct; and a once-through heating area disposed in the heating-gas duct through which a heating gas flow is conducted, said once-through heating area being formed from a plurality of single-row header-and-tube assemblies, each of said plurality of single-row header-and-tube assemblies including a plurality of steam generator tubes connected in parallel for a through flow of a flow medium therethrough, each of said plurality of single-row header-and-tube assemblies further including an inlet header connected to said inlet manifold and a discharge header connected to said discharge manifold, each of said inlet headers being connected to said inlet manifold via a respective one of a plurality of first link pipes, each of said discharge headers being connected to said discharge manifold via a respective one of a plurality of second link pipes, and each of said steam generator tubes of each of said single-row header-and-tube assemblies having an inside diameter that is less than an inside diameter of any of said plurality of first link pipes and of any of said plurality of second link pipes.

2. The steam generator of claim 1, wherein the heating gas flow is conducted in an approximately horizontal heating-gas direction.

3. The steam generator of claim 1, wherein:

at least one of said plurality of steam generator tubes associated with a first one of said plurality of single-row header-and-tube assemblies is heated to a greater extent than at least one of said plurality of steam generator tubes associated with a second one of said plurality of single-row header-and-tube assemblies; and said at least one steam generator tube associated with said first single-row header-and-tube assembly has a higher flow rate of the flow medium therethrough than said at least one steam generator tube associated with said second single-row header-and-tube assembly.

4. The steam generator of claim 1, wherein:

said inlet manifold has an inside diameter greater than an inside diameter of each of said inlet headers; and said discharge manifold has an inside diameter greater than an inside diameter of each of said discharge headers.

5. The steam generator of claim 1, wherein each steam generator tube of a first one of said plurality of single-row header-and-tube assemblies has a higher flow rate of the flow medium therethrough than each steam generator tube of a second one of said plurality of single-row header-and-tube assemblies disposed downstream of said first one of said plurality of single-row header-and-tube assembly in the heating gas flow direction.

6. The steam generator of claim 1, wherein each steam generator tube of a first one of said plurality of single-row header-and-tube assemblies has a larger inside diameter than each steam generator tube of a second one of said plurality of single-row header-and-tube assemblies disposed downstream of said first one of said plurality of single-row header-and-tube assemblies in the heating gas flow direction.

7. The steam generator of claim 1, wherein at least one steam generator tube of at least one of said plurality of single-row header-and-tube assemblies includes a choke device.

8. The steam generator of claim 1, wherein:

each of said inlet headers is connected to said inlet manifold via a respective one of said plurality of first link pipes; and at least one of said plurality of first link pipes includes a choke device.

9. The steam generator of claim 1, wherein said once-through heating area is a first once-through heating area, said inlet manifold is a first inlet manifold, said discharge manifold is a first discharge manifold, and further comprising:

a second once-through heating area disposed in said heating-gas duct, said second once-through heating area being formed from another plurality of single-row header-and-tube assemblies, each of said another plurality of single-row header-and-tube assemblies including a plurality of steam generator tubes connected in parallel for a through flow of the flow medium therethrough, each of said another plurality of single-row header-and-tube assemblies including an inlet header connected to a second inlet manifold and a discharge header connected to a second discharge manifold.

10. The steam generator of claim 1, wherein said steam generator is a heat recovery steam generator.

11. The steam generator of claim 1, wherein said once-through heating area has on average a ratio of friction pressure loss to geodetic pressure drop at full load of less than 0.4.

12. The steam generator of claim 1, wherein said plurality of steam generator tubes of said once-through heating area has on average a ratio of friction pressure loss to geodetic pressure drop at full load of less than 0.2.

* * * * *